United States Patent [19]

Sladkoshteev et al.

[11] 4,159,734

[45] Jul. 3, 1979

[54] CONTINUOUS CASTING APPARATUS

[76] Inventors: Vladimir T. Sladkoshteev, ulitsa Dzerzhinskogo, 34, kv. 11; Oleg A. Shatagin, ulitsa Melnikova, 47, kv. 9; Samuil F. Khalemsky, ulitsa Kharkovskikh divizy, 7/1, kv. 31; Viktor V. Sachko, ulitsa Danilevskogo, 10, kv. 147/148; Ivan A. Yakunin, ulitsa Zernovaya, 6/4, kv. 87; Boris F. Abraimov, ulitsa 23 Avgusta, 47, kv. 65, all of Kharkov, U.S.S.R.

[21] Appl. No.: 762,733

[22] Filed: Jan. 26, 1977

[51] Int. Cl.[2] ..... B22D 11/08

[52] U.S. Cl. ..... 164/426

[58] Field of Search ..... 164/82, 274, 425, 426, 164/447, 448, 445, 446, 440

[56] References Cited

U.S. PATENT DOCUMENTS

| | | | |
|---|---|---|---|
| 3,266,104 | 8/1966 | Foldessy | 164/274 |
| 3,525,381 | 8/1970 | Leese | 164/82 |
| 3,587,716 | 6/1971 | Ciochetto | 164/274 |

*Primary Examiner*—Richard B. Lazarus
*Assistant Examiner*—John S. Brown
*Attorney, Agent, or Firm*—Lackenbach, Lilling & Siegel

[57] ABSTRACT

A continuous casting apparatus comprises a mold and a tundish connected to each other by means of a refractory conduit capable of withstanding several cycles of casting operations. Used on the continuous-casting apparatus is a dummy bar assembly whose head is bevelled on both sides thereof adjoining the mold wall. The bevelled portions of the dummy-bar head and the mold wall define a gap expanding in the direction of the withdrawal of the ingot. A sealing material, such as asbestos string, is placed in the gap and tamped therein by a special means.

3 Claims, 2 Drawing Figures

CONTINUOUS CASTING APPARATUS

BACKGROUND OF THE INVENTION

The present invention relates to metallurgy, and more particularly to continuous casting apparatus.

The invention is especially well suited for application with continuous-casting machines used for casting ferrous metals and alloys thereof, said machines featuring either horizontal or inclined arrangement of the mold connected to the tundish by a refractory conduit.

Prior to starting the casting operation on a continuous-casting machine, a dummy bar assembly, equipped with a head section fixedly attached to a carrying section, is fed into the mold. To prevent leakage of the molten metal through the gap formed between the mold walls and the dummy-bar head, the gap is packed with a heat-resistant material, such as asbestos string.

The gap is sealed with refractory material at the side of the dummy-bar head facing the metal being poured into the mold cavity. The dummy bar is then connected with the mold and the tundish to be filled with the molten metal.

As casting commences, the dummy bar is withdrawn from the mold together with the cast product. On completion of the casting process, the refractory conduit, connecting the mold to the tundish, is disposed of. Preparation of such a machine for the continuous casting operation, the casting operation itself and the disposal of the conduit make up a complete casting or operating cycle.

Recently, there have been developed refractory materials for the fabrication of conduits capable of withstanding several casting cycles. The disposal of conduits which are still serviceable and usable in subsequent casting cycles is necessitated by the difficulties encountered during the sealing operation to be performed with the dummy bar being fed into the mold. The packing of the gap, formed between the head section and the mold wall, can only be accomplished if approached from the side of the dummy-bar head facing the metal being cast within the mold. Therefore, the destruction of the still serviceable conduit results in higher production costs and lower operating rates.

U.S. Pat. No. 3,262,161 describes a dummy bar for use on a continuous casting machine equipped with a head section having its surface, looking in the direction of the metal being cast, fitted with an elastic heat-resistant annular packing. As the dummy bar is fed into the mold, the edges of the packing fit in the gap between the mold walls and the lateral surfaces of the dummy-bar head.

However, the use of the dummy bar disclosed in the patent referred to above is associated with certain difficulties. There is a danger that reliable sealing will not be ensured with the dummy bar run up into a mold cavity which has its outlet opening of a smaller cross section than that of its inlet opening. The heat-resistant elastic material used for sealing must have, practically, no residual strain and be capable of increasing its thickness from 1–2 mm up to 3–10 mm.

The sealing material which exhibits elasticity and resistance to heat at high temperatures is most likely to be very expensive. The use of elastic and heat-resistant materials for sealing a dummy-bar head not tapered relative to the mold walls may also turn out to be economically unjustifiable.

F.R.G. Pat. No. 1,954,107 discloses a dummy bar wherein the gap between the dummy-bar head and the mold walls is packed with a heat resistant material, such as asbestos, from the side of feeding of the molten metal.

However, with a conventional mold having its face wall looking in the direction of delivery of the molten metal, it will be impossible to fill in the gap between the dummy-bar head and the lateral surfaces of the mold wall from the face side thereof.

Therefore, it becomes necessary to fill in the gap from the side of exit of the cast ingot.

However, if packing of the gap is attempted from the side from which the cast ingot issues, reliable packing will not be ensured throughout the entire perimeter of the dummy-bar head and the dummy bar may even be jammed inside the mold.

SUMMARY OF THE INVENTION

It is, therefore, an object of the present invention to provide a continuous casting machine using a dummy bar assembly fitted with a sealing which allows several cycles of casting operations and obviates the need to dispose of or to destruct the conduit employed therein.

Another object of the invention is to simplify the operation of sealing the mold at the place of positioning the dummy-bar head.

Still another object of the invention is to increase the operating rate of a continuous casting machine.

Yet another object of the invention is to cut the operating costs of a continuous casting apparatus.

Yet still another object of the invention is to eliminate the possibility of jamming the dummy bar inside the mold of a continuous casting apparatus.

These and other objects and features of the invention are attained in a continuous casting apparatus comprising a tundish and a mold connected to each other by a refractory conduit capable of withstanding several cycles of casting operations, and a dummy bar fed into said mold and equipped with a head section packed with a heat-resistant material on its perimeter relative to the mold walls adjacent thereto. According to the invention, the dummy-bar head has formed on both sides thereof adjoining the mold wall bevelled portions tapering towards its end surface facing the metal being poured into the mold. The bevelled portions together with the mold define a gap expanding in the direction of withdrawal of the cast ingot and intended for the sealing material to be placed therein.

The herein proposed invention allows for several cycles of casting operations to be performed without the need of disposing of or destroying the refractory conduit used therein. This being accomplished by sealing the mold from the side thereof opposite to that of the metal delivery, thus making it possible to decrease the degree of wear of said sealing caused by the contact with the molten metal and to replace the used seal with a new one through the mold cavity. In addition, the proposed invention will simplify the operation of sealing the mold at the place of positioning the dummy-bar head. The above-mentioned features of the invention make it possible to increase the production rate of and cut the operating cost of a continuous casting apparatus. Moreover, an easier access to the places of the sealing disposition or location ensures a more tight and uniform sealing which decreases occurrences of jamming.

It is preferable that the dummy-bar head be formed with bevelled portions extending throughout the entire perimeter of the dummy-bar head.

It is advantageous that provision be made for a means for tamping the seal into position, said means being made as a frame conforming to the shape of the bevelled portion of the dummy-bar head and rigidly connected with at least one screw pair having its screw interacting with a thrust member provided on the dummy bar carrier.

BRIEF DESCRIPTION OF THE DRAWING

The present invention will be further described in terms of a specific embodiment thereof, taken in conjunction with the accompanying drawings. In the drawing.

DESCRIPTION OF THE PREFERRED EMBODIMENT

Figure 1:
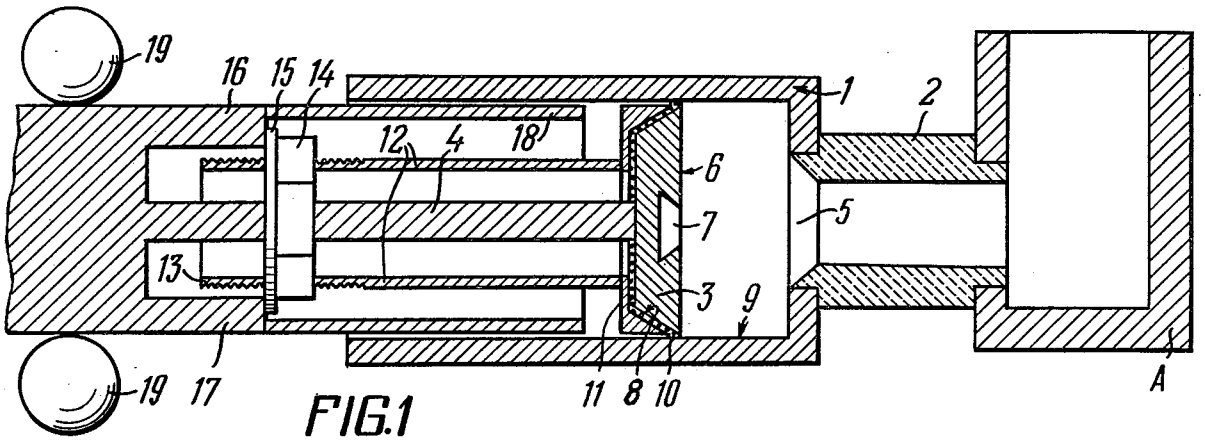
FIG. 1 is a longitudinal cross-section view of a continuous casting apparatus, according to the invention.

Referring now to FIG. 1, there is shown therein a continuous casting apparatus which comprises a tundish A and a mold 1 connected to each other by a refractory conduit 2. Fed into the mold 1 is a dummy bar assembly equipped with a head section or head 3 attached to a carrying section or shank 4.

The dummy-bar head 3 is made detachable so that it can be easily disconnected from the cast ingot (not shown). A circular or rectangular shape of the lateral surface of the dummy-bar head 3 conforms in profile to the cross-section of the interior surface of the mold 1. The mold 1 has an inlet opening 5 through which the molten metal is to be fed. A surface 6 of the head 3 is formed with a dovetail groove 7 intended for keying the dummy-bar head 3 onto the first metal poured into the mold 1.

The dummy-bar head 3 is formed on both sides thereof relative to the surface 6 with bevelled portions 8. The bevelled portions 8 together with a wall 9 of the mold 1 define a gap, wherein a sealing 10 is arranged or placed along the side of the dummy-bar carrying section or shank 4. Thus, the bevelled portions 8 and the walls of the mold 1 form a gap expanding in the direction of withdrawal of the cast ingot.

The present invention makes provision for a special means adapted to tamp the seal 10 into position, said means being made as a frame 11 with a shape conforming to the profile of the gap formed between the wall of the mold 1 and the bevelled portions 8 of the dummy-bar head 3. Accordingly, the frame 11 is likewise formed with bevelled portions tapering at the same angle as those shown at 8 and is readily brought in contact with the bevelled portions 8 if so adjusted. The frame 11 is arranged or located around the dummy-bar carrying section or shank 4.

The frame 11 is rigidly connected with a screw pair, in the given embodiment it is a tube 12, which is formed with a screw thread 13 and a nut 14 fitted on the free end of the tube and thrusting up through a washer 15 against a thrust member 16 formed in a body 17 of the dummy bar assembly. The tube 12, the nut 14 and the washer 15 are enclosed in a casing 18 rigidly connected with the dummy-bar body 17.

The walls of the casing 18 are thick enough to withstand the pressure applied by withdrawal rolls 19.

Figure 2:
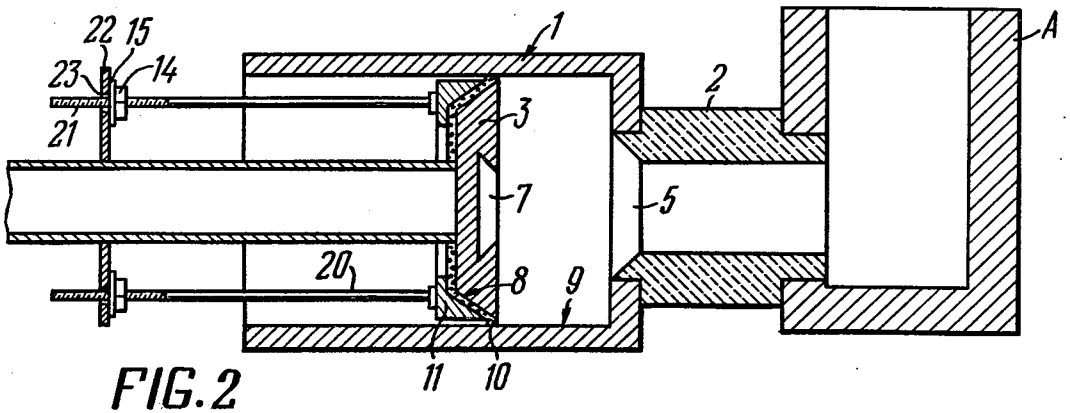
FIG. 2 is a longitudinal cross-section view of the apparatus shown in FIG. 1, wherein there is provided a special means for tamping a seal into position.

The means for tamping the seal 10 into position may be provided with a plurality of screw pairs, for example with two of them, such as shown in FIG. 2. In this case, a frame 11 is rigidly connected with rods 20 formed with a screw thread 21, a nut 14 and a washer 15. The dummy bar carrying the section or shank 4 is formed with a thrust member 22 having holes 23 through which extend ends of the rods 20.

The continuous casting machine of the invention, in combination with the hereinbefore described seal-tamping means, operates in the following manner. Prior to inserting the dummy-bar head 3 (see FIGS. 1 and 2) into the mold 1 connected to the tundish A by the refractory conduit 2, the frame 11 is brought away from the head 3 to its extreme position. Thereafter the dummy-bar head 3 is fed into the mold 1. The seal 10, such as asbestos string, is placed along the perimeter of the head 3 from the side of the carrying section or shank 4 thereof so as to fill in the gap between the bevelled portion 8 the dummy-bar head 3 and the walls of the mold 1. The nut 14 (see FIG. 1) is then turned and the tube 12 is actuated to move the frame 11 from the thrust member 16 towards the dummy-bar head 3.

The rods 20 are actuated in a similar fashion by corresponding adjustment of the nuts 14 (see FIG. 2), said rods carrying the frame 11 whose bevelled portions are brought together with bevelled portions 8 of the dummy-bar head 3, thereby tamping the seal 10 into the gap. The frame 11, moved over the dummy-bar head 3, provides reliable tightening of the gap with the aid of the seal 10, the cavity of the mold 1 being ready to receive the molten metal therein.

The molten metal is fed from the tundish A into the mold 1 through the inlet opening 5 along the refractory conduit 2. As the cavity of the mold 1 is filled with the molten metal, its level is getting high enough for the metal to pass into the dovetail groove 7 formed in the dummy-bar head 3 wherein it solidifies.

The dummy-bar assembly provides reliable sealing of the gap between the head 3 thereof and the walls of the mold 1. Moreover, it became possible to eliminate jamming of the dummy bar in the mold and thereby to provide a stable continuous-casting process.

After the cast ingot is withdrawn from the mold 1 by the withdrawal rolls 19 and after leaving the mold, the dummy-bar head 3 is detached from its carrying section to be thereafter disconnected into parts and separated from the cast product.

What is claimed is:

1. A continuous casting apparatus comprising a tundish; a mold connected to said tundish by a refractory conduit capable of withstanding a plurality of casting cycles; a dummy-bar fed into said mold and equipped with a head section packed with a heat-resistant material on its surface adjacent the mold walls, sides of said dummy-bar head adjoining the mold wall being formed with bevelled portions decreasingly tapering in the direction of withdrawal of the cast ingot from the mold, said bevelled portions together with the mold wall forming a gap expanding in the direction of withdrawal of the cast ingot; and a sealing material placed in said gap and means for tamping the seal into position, said means for tamping being disconnectable relative to the dummy-bar head and located behind the dummy-bar head.

2. An apparatus as claimed in claim 1, wherein said bevelled portions of the dummy-bar head extend throughout the entire perimeter of the dummy-bar.

3. An apparatus as claimed in claim 1, wherein said means for tamping the seal into position is made as a frame conforming in shape to that of the bevelled portions of the dummy-bar head and being rigidly connected with at least one screw pair having its screw interacting with a thrust member formed on a carrying section of said dummy bar.

* * * * *